US009804513B2

(12) United States Patent
Vanbesien et al.

(10) Patent No.: US 9,804,513 B2
(45) Date of Patent: Oct. 31, 2017

(54) TONER COMPOSITIONS

(71) Applicant: Xerox Corporation, Norwalk, CT (US)

(72) Inventors: Daryl Vanbesien, Burlington (CA); Yixin Gong, Mississauga (CA); Karen A Moffat, Brantford (CA); Richard P N Veregin, Mississauga (CA); Cuong Vong, Hamilton (CA); Jordan H Wosnick, Toronto (CA); Suxia Yang, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/327,695

(22) Filed: Jul. 10, 2014

(65) Prior Publication Data

US 2017/0031254 A1 Feb. 2, 2017

Related U.S. Application Data

(63) Continuation of application No. 12/248,939, filed on Oct. 10, 2008, now abandoned.

(51) Int. Cl.

| | |
|---|---|
| ***G03G 9/093*** | (2006.01) |
| ***G03G 9/08*** | (2006.01) |
| ***G03G 9/087*** | (2006.01) |
| ***G03G 9/09*** | (2006.01) |

(52) U.S. Cl.

CPC ..... *G03G 9/0804* (2013.01); *G03G 9/0806* (2013.01); *G03G 9/0819* (2013.01); *G03G 9/0827* (2013.01); *G03G 9/08704* (2013.01); *G03G 9/08708* (2013.01); *G03G 9/08711* (2013.01); *G03G 9/08726* (2013.01); *G03G 9/08728* (2013.01); *G03G 9/091* (2013.01); *G03G 9/09392* (2013.01)

(58) Field of Classification Search

CPC ..... G03G 9/0804; G03G 9/09392; G03G 9/0806

USPC ..... 430/137.14, 137.11

See application file for complete search history.

(56) References Cited

U.S. PATENT DOCUMENTS

| | | | |
|---|---|---|---|
| 5,527,658 | A | 6/1996 | Hopper et al. |
| 7,037,633 | B2 | 5/2006 | Hopper et al. |
| 8,431,318 | B2 | 4/2013 | Vanbesien et al. |
| 2002/0187415 | A1 | 12/2002 | Jiang et al. |
| 2004/0197693 | A1 | 10/2004 | Ninomiya et al. |
| 2005/0175918 | A1 | 8/2005 | Tomita et al. |
| 2006/0045173 | A1 | 3/2006 | Phogat et al. |
| 2006/0166121 | A1 | 7/2006 | Patel et al. |
| 2006/0222989 | A1 | 10/2006 | Vanbesien et al. |
| 2007/0111128 | A1 | 5/2007 | Patel et al. |
| 2007/0207400 | A1 | 9/2007 | Ahuja et al. |
| 2008/0063965 | A1 | 3/2008 | Lai et al. |
| 2008/0138730 | A1 | 6/2008 | Lai et al. |

FOREIGN PATENT DOCUMENTS

| | | |
|---|---|---|
| JP | 2004-294751 | 10/2001 |

OTHER PUBLICATIONS

Japanese Patent Office J-PlatPat machine-assisted English-language translation of JP 2004-294751 (pub. Oct. 2004).*

* cited by examiner

*Primary Examiner* — Janis L Dote

(74) *Attorney, Agent, or Firm* — Marylou J. Lavoie, Esq. LLC

(57) ABSTRACT

The present disclosure provides processes for producing toners by emulsion aggregation where the resulting toner particles have high pigment loadings and desired circularity. The methods include adding a metal, in embodiments a metal salt, at the beginning of coalescence, which surprisingly speeds the coalescence process and produces toner particles having a desired size and circularity for use in electrophotographic imaging systems.

16 Claims, 3 Drawing Sheets

TONER COMPOSITIONS

The instant application is a continuation of U.S. Ser. No. 12/248,939 that was filed 10 Oct. 2008.

BACKGROUND

The present disclosure relates to processes useful in providing toners suitable for electrophotographic apparatuses, including xerographic apparatuses such as digital, image-on-image, and similar apparatuses.

Numerous processes are known for the preparation of toners, such as, for example, conventional processes wherein a resin is melt kneaded or extruded with a pigment, micronized and pulverized to provide toner particles. Toner can also be produced by emulsion aggregation methods. Methods of preparing an emulsion aggregation (EA) type toner are within the purview of those skilled in the art, and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

The development of highly pigmented toners may affect the toner formation process, with difficulties arising in forming toner particles having a desired size and shape.

Improved methods for producing toner remain desirable.

SUMMARY

The present disclosure provides processes for producing toners. In embodiments, a process of the present disclosure may include contacting at least one resin with at least one colorant, at least one surfactant, and an optional wax to form an emulsion possessing small particles, aggregating the small particles, adding a metal salt selected from the group consisting of copper, iron, and alloys thereof to the small particles, coalescing the aggregated particles to form toner particles, and recovering the toner particles.

In other embodiments, a process of the present disclosure may include contacting at least one resin with at least one colorant, at least one surfactant, an optional wax, and an optional stabilizer of the following formula (I):

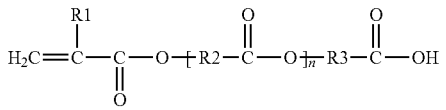

where R1 is hydrogen or a methyl group, R2 and R3 are independently either alkylene groups containing from about 1 to about 12 carbon atoms or a phenylene group, and n is from about 0 to about 20, to form an emulsion possessing small particles. The small particles are aggregated, and a metal salt including a metal such as copper, iron, and alloys thereof, and a salt including nitrates, sulfates, halides, acetates, phosphates, oxides, hydroxides, carbonates, and combinations thereof are added to the small particles. The aggregated particles are coalesced to form toner particles and the toner particles are recovered.

In other embodiments, a process of the present disclosure includes contacting at least one resin with at least one surfactant, an optional wax, at least one colorant, and a stabilizer such as beta carboxyethyl acrylate (β-CEA), poly (2-carboxyethyl)acrylate, 2-carboxyethyl methacrylate, and combinations thereof, to form an emulsion possessing small particles; aggregating the small particles; adding to the small particles a metal such as copper, iron, and alloys thereof and a salt such as nitrates, sulfates, halides, acetates, phosphates, oxides, hydroxides, carbonates, and combinations thereof; coalescing the aggregated particles to form toner particles for a period of time of from about 0.5 hours to about 12 hours; and recovering the toner particles, wherein the colorant comprises dyes, pigments, combinations of dyes, combinations of pigments, and combinations of dyes and pigments, in an amount of from about 8 to about 40 percent by weight of the toner, and wherein the toner particles have a circularity of from about 0.95 to about 0.998.

BRIEF DESCRIPTION OF THE FIGURES

Various embodiments of the present disclosure will be described herein below with reference to the figures wherein.

DETAILED DESCRIPTION OF EMBODIMENTS

Figure 1:
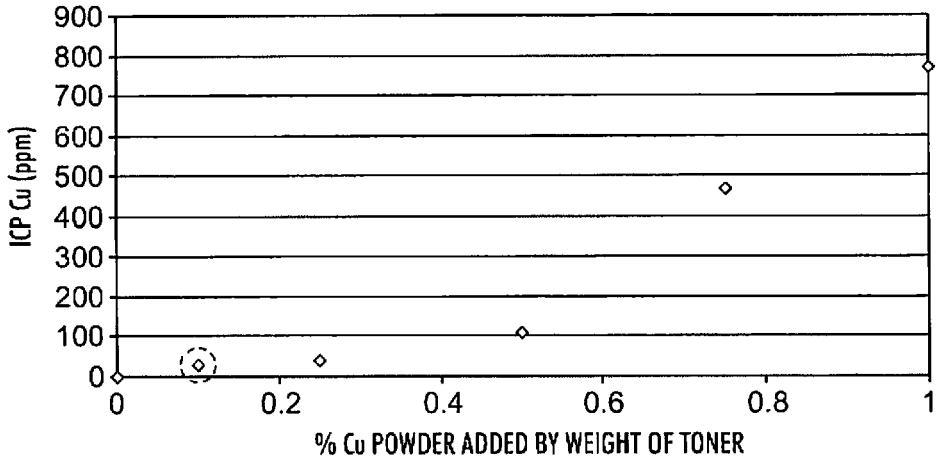
FIG. 1 is a graph depicting the amount of copper added to a toner of the present disclosure compared with the retained copper in the final toner as determined by Inductively coupled Plasma Emission Spectroscopy (ICP)

The present disclosure provides processes for the preparation of toner particles which may avoid problems arising in the formation of highly pigmented particles. In embodiments, a transition metal powder and/or a transition metal salt may be added to toner particles during an emulsion aggregation synthesis to facilitate rapid coalescence of the toner particles, with the toner particles possessing a high degree of circularity.

Toners of the present disclosure may include a latex resin in combination with a pigment. While the latex resin may be prepared by any method within the purview of those skilled in the art, in embodiments the latex resin may be prepared by emulsion polymerization methods, including semi-continuous emulsion polymerization, and the toner may include emulsion aggregation toners. Emulsion aggregation involves aggregation of both submicron latex and pigment particles into toner size particles, where the growth in particle size is, for example, in embodiments from about 0.1 micron to about 15 microns.

Resin

Any monomer suitable for preparing a latex for use in a toner may be utilized. Such latexes may be produced by conventional methods. As noted above, in embodiments the toner may be produced by emulsion aggregation. Suitable monomers useful in forming a latex emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the resin of the latex may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-alkyl methacrylate), poly(styrene-alkyl acrylate-acrylic acid), poly(styrene-alkyl methacrylate-acrylic acid), poly (alkyl methacrylate-alkyl acrylate), poly(alkyl methacrylate-aryl acrylate), poly(aryl methacrylate-alkyl acrylate), poly (alkyl methacrylate-acrylic acid), poly(styrene-alkyl acrylate-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly (methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and combinations thereof. The polymer may be block, random, or alternating copolymers.

In embodiments, a poly(styrene-butyl acrylate) may be utilized as the latex. The glass transition temperature of this latex may be from about 35° C. to about 75° C., in embodiments from about 40° C. to about 70° C.

Surfactants

In embodiments, the latex may be prepared in an aqueous phase containing a surfactant or co-surfactant. Surfactants which may be utilized with the resin to form a latex dispersion can be ionic or nonionic surfactants in an amount of from about 0.01 to about 15 weight percent of the solids, and in embodiments of from about 0.1 to about 10 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

Initiators

In embodiments initiators may be added for formation of the latex. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine) dihydrochloride, 2,2'-azobis[N-(4-chlorophenyl)-2-methylpropionamidine]di-hydrochloride, 2,2'-azobis[N-(4-hydroxyphenyl)-2-methyl-propionamidine] dihydrochloride, 2,2'-azobis[N-(4-amino-phenyl)-2-methylpropionamidine]tetrahydrochloride, 2,2'-azobis[2-methyl-N(phenylmethyl)propionamidine]dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4, 5,6,7-tetrahydro-1H-1,3-diazepin-2-yl)propane] dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis{2-[1-(2-hydroxyethyl)-2-imidazolin-2-yl]propane}dihydrochloride, combinations thereof, and the like.

Initiators can be added in suitable amounts, such as from about 0.1 to about 8 weight percent, and in embodiments of from about 0.2 to about 5 weight percent of the monomers.

Chain Transfer Agents

In embodiments, chain transfer agents may also be utilized in forming the latex. Suitable chain transfer agents include dodecane thiol, octane thiol, carbon tetrabromide, combinations thereof, and the like. Where utilized, chain transfer agents may be present in amounts from about 0.1 to about 10 percent and, in embodiments, from about 0.2 to about 5 percent by weight of monomers, to control the molecular weight properties of the polymer when emulsion polymerization is conducted in accordance with the present disclosure.

Stabilizers

In embodiments, it may be advantageous to include a stabilizer when forming the latex particles. Suitable stabilizers include monomers having carboxylic acid functionality. Such stabilizers may be of the following formula (I):

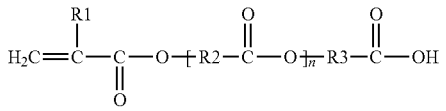

where R1 is hydrogen or a methyl group; R2 and R3 are independently selected from alkylene groups containing from about 1 to about 12 carbon atoms or a phenylene group; n is from about 0 to about 20, in embodiments from about 1 to about 10. Examples of such stabilizers include beta carboxyethyl acrylate (β-CEA), poly(2-carboxyethyl)acrylate, 2-carboxyethyl methacrylate, combinations thereof, and the like. Other stabilizers which may be utilized include, for example, acrylic acid and its derivatives.

In embodiments, the stabilizer having carboxylic acid functionality may also contain a small amount of metallic ions, such as sodium, potassium and/or calcium, to achieve better emulsion polymerization results. The metallic ions may be present in an amount from about 0.001 to about 10 percent by weight of the stabilizer having carboxylic acid functionality, in embodiments from about 0.5 to about 5 percent by weight of the stabilizer having carboxylic acid functionality.

Where present, the stabilizer may be added in amounts from about 0.01 to about 5 percent by weight of the toner, in embodiments from about 0.05 to about 2 percent by weight of the toner.

Additional stabilizers that may be utilized in the toner formulation processes include bases such as metal hydroxides, including sodium hydroxide, potassium hydroxide, ammonium hydroxide, and optionally combinations thereof. Also useful as a stabilizer is sodium carbonate, sodium bicarbonate, calcium carbonate, potassium carbonate, ammonium carbonate, combinations thereof, and the like. In embodiments a stabilizer may include a composition containing sodium silicate dissolved in sodium hydroxide.

pH Adjustment Agent

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Reaction Conditions

In the emulsion aggregation process, the reactants may be added to a suitable reactor, such as a mixing vessel. The appropriate amount of at least two monomers, in embodiments from about two to about ten monomers, stabilizer, surfactant(s), initiator, if any, chain transfer agent, if any, and wax, if any, and the like may be combined in the reactor and the emulsion aggregation process may be allowed to begin. Suitable waxes are described in greater detail below as a component to be added in the formation of a toner particle; such waxes may also be useful, in embodiments, in forming a latex. Reaction conditions selected for effecting the emulsion polymerization include temperatures of, for example, from about 45° C. to about 120° C., in embodiments from about 60° C. to about 90° C. In embodiments the polymerization may occur at elevated temperatures within about 10 percent of the melting point of any wax present, for example from about 60° C. to about 85° C., in embodiments from about 65° C. to about 80° C., to permit the wax to soften thereby promoting dispersion and incorporation into the emulsion.

Nanometer size particles may be formed, from about 50 nm to about 800 nm in volume average diameter, in embodiments from about 100 nm to about 400 nm in volume average diameter, as determined, for example, by a Brookhaven nanosize particle analyzer.

After formation of the latex particles, the latex particles may be utilized to form a toner. In embodiments, the toners may be an emulsion aggregation type toner that are prepared by the aggregation and fusion of the latex particles of the present disclosure with a colorant, and one or more additives such as surfactants, coagulants, waxes, surface additives, and optionally combinations thereof.

Colorants

The latex particles produced as described above may be added to a colorant to produce a toner. In embodiments the colorant may be in a dispersion. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. Suitable surfactants include any of those surfactants described above. In embodiments, the surfactant may be ionic and may be present in a dispersion in an amount from about 0.1 to about 25 percent by weight of the colorant, and in embodiments from about 1 to about 15 percent by weight of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or mixtures thereof.

In embodiments wherein the colorant is a pigment, the pigment may be, for example, carbon black, phthalocyanines, quinacridones or RHODAMINE B™ type, red, green, orange, brown, violet, yellow, fluorescent colorants, and the like.

Exemplary colorants include carbon black like REGAL 330™ magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido)phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight of the toner, in embodiments, from about 5 to about 18 weight percent of the toner.

In embodiments, colorant examples include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant.

In embodiments, toners of the present disclosure may have high pigment loadings. As used herein, high pigment loadings include, for example, toners having a colorant in an amount of from about 8 percent by weight of the toner to about 40 percent by weight of the toner, in embodiments from about 10 percent by weight of the toner to about 18 percent by weight of the toner. These high pigment loadings may be important for certain colors such as PANTONE® Orange, Process Blue, PANTONE® yellow, and the like. (The PANTONE® colors refer to one of the most popular color guides illustrating different colors, wherein each color is associated with a specific formulation of colorants, and is published by PANTONE, Inc., of Moonachie, N.J.) One issue with high pigment loading is that it may reduce the ability of the toner particles to spherodize, that is, become circular, during the coalescence step, even at a very low pH.

The resulting latex, optionally in a dispersion, and colorant dispersion may be stirred and heated to a temperature of from about 35° C. to about 70° C., in embodiments of from about 40° C. to about 65° C., resulting in toner aggregates of from about 2 microns to about 10 microns in volume average diameter, and in embodiments of from about 5 microns to about 8 microns in volume average diameter.

Coagulants

In embodiments, a coagulant may be added during or prior to aggregating the latex and the aqueous colorant dispersion. The coagulant may be added over a period of time from about 1 minute to about 60 minutes, in embodiments from about 1.25 minutes to about 20 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to contain the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.01 to about 5 percent by weight of the toner, and in embodiments from about 0.1 to about 3 percent by weight of the toner.

Wax

Wax dispersions may also be added during formation of a latex or toner in an emulsion aggregation synthesis. Suitable waxes include, for example, submicron wax particles in the size range of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 0.5 to about 15 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. In embodiments, commercially available polyethylene waxes possess a molecular weight (Mw) of from about 100 to about 5000, and in embodiments of from about 250 to about 2500, while the commercially available polypropylene waxes have a molecular weight of from about 200 to about 10,000, and in embodiments of from about 400 to about 5000.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, JONCRYL 74, 89, 130, 537, and 538, all available from Johnson Diversey, Inc, or chlorinated polypropylenes and polyethylenes commercially available from Allied Chemical, Baker Petrolite Corporation and Johnson Diversey, Inc.

The wax may be present in an amount of from about 0.1 to about 30 percent by weight of the toner, and in embodiments from about 2 to about 20 percent by weight of the toner.

Aggregating Agents

Any aggregating agent capable of causing complexation might be used in forming toners of the present disclosure. Both alkaline earth metal or transition metal salts can be utilized as aggregating agents. In embodiments, alkaline earth salts can be selected to aggregate latex resin colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like.

pH Adjustment Agent

In some embodiments a pH adjustment agent may be added to the latex, colorant, and optional additives, to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

For example, once the desired final size of the toner particles is achieved, the pH of the mixture may be adjusted with a base to a value of from about 3.5 to about 7, and in embodiments from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 15 percent by weight of the mixture.

The resultant blend of latex, optionally in a dispersion, stabilizer, optional wax, colorant dispersion, optional coagulant, and optional aggregating agent, may then be stirred and heated to a temperature below the Tg of the latex, in embodiments from about 30° C. to about 70° C., in embodiments of from about 40° C. to about 65° C., for a period of time of from about 0.2 hours to about 6 hours, in embodiments from about 0.3 hours to about 5 hours, to form aggregated particles.

In embodiments, an optional shell may then be formed on the aggregated particles. Any latex described above to form the latex may be utilized to form the shell latex. In embodiments, a styrene-n-butyl acrylate copolymer may be utilized to form the shell latex. In embodiments, the latex utilized to form the shell may have a glass transition temperature of from about 35° C. to about 75° C., in embodiments from about 40° C. to about 70° C.

Where used, the shell latex may be applied by any method within the purview of those skilled in the art, including dipping, spraying, and the like. In embodiments, a shell may be applied by adding additional latex to the aggregated particles and allowing this additional latex to aggregate on the surface of the particles, thereby forming a shell thereover. Any resin within the purview of those skilled in the art, including those resins described above, may be utilized as a shell latex. The shell latex may be applied until the desired final size of the toner particles is achieved, in embodiments from about 2 microns to about 10 microns, in other embodiments from about 4 microns to about 8 microns.

Sequestering Agents

In embodiments an organic sequestering agent may be added to the mixture during aggregation of the particles. Such sequestering agents and their use in forming toners are described, for example, in U.S. Pat. No. 7,037,633, the disclosure of which is hereby incorporated by reference in its entirety. In embodiments, suitable organic sequestering agents include, for example, organic acids such as ethylene diamine tetra acetic acid (EDTA), GLDA (commercially available L-glutamic acid N,N diacetic acid), humic and fulvic acids, penta-acetic and tetra-acetic acids; salts of organic acids including salts of methylglycine diacetic acid (MGDA), and salts of ethylenediamine disuccinic acid (EDDS); esters of organic acids including sodium gluconate, magnesium gluconate, potassium gluconate, potassium and sodium citrate, nitrotriacetate (NTA) salt; substituted pyranones including maltol and ethyl-maltol; water soluble polymers including polyelectrolytes that contain both carboxylic acid (COOH) and hydroxyl (OH) functionalities; and combinations thereof. Examples of specific sequestering agents include EDTA, MGDA and EDDS.

In embodiments, EDTA, a salt of methylglycine diacetic acid (MGDA), or a salt of ethylenediamine disuccinic acid (EDDS), may be utilized as a sequestering agent.

The amount of sequestering agent added may be from about 0.25 pph to about 4 pph, in embodiments from about 0.5 pph to about 2 pph. The sequestering agent complexes or chelates with the coagulant metal ion, such as aluminum, thereby extracting the metal ion from the toner aggregate particles. The amount of metal ion extracted may be varied with the amount of sequestering agent, thereby providing controlled crosslinking. For example, in embodiments, adding about 0.5 pph of the sequestering agent (such as EDTA) by weight of toner, may extract from about 40 to about 60 percent of the aluminum ions, while the use of about 1 pph of the sequestering agent (such as EDTA) may result in the extraction of from about 95 to about 100 percent of the aluminum.

Coalescence

The mixture of latex, colorant, optional wax, and any additives, is subsequently coalesced. Coalescing may include stirring and heating at a temperature of from about 80° C. to about 99° C., for a period of from about 0.5 to about 12 hours, and in embodiments from about 1 to about 6 hours. Coalescing may be accelerated by additional stirring.

As noted above, one issue with high pigment loading for toners of the present disclosure is that it may reduce the ability of the toner to spherodize during the coalescence step, even at a very low pH. Thus, in embodiments, a transition metal powder and/or a transition metal salt may be added to the mixture of latex, colorant, optional wax, and any additives, at the beginning of the coalescence process. Suitable metals include, for example, copper, zinc, iron, cobalt, nickel, molybdenum, manganese, chromium, vanadium, and/or titanium, as well as metal alloys such as copper/zinc alloys.

In other embodiments, elemental copper or copper salts, iron or iron salts, or combinations thereof, may be utilized to speed coalescence and obtain desired particle circularity for a toner of the present disclosure. Examples of such copper and/or iron salts include nitrates, sulfates, halides, acetates, phosphates, oxides, hydroxides, carbonates, combinations thereof, and the like. In embodiments, the salt may be insoluble. The degree of solubility may be, for example:

nitrates—soluble
sulfates—soluble
halides—soluble
acetates—soluble
phosphates—insoluble
oxides—insoluble
hydroxides—insoluble
carbonates—insoluble In embodiments, a copper nitrate, such as copper II nitrate, may be utilized as the metal salt. In other embodiments, an iron salt such as iron nitrate may be utilized as the metal salt.

The amount of metal powder added to the mixture may be from about 0.01 weight percent to about 4 weight percent, in embodiments from about 0.09 to about 1 weight percent. The amount of metal salt added to the mixture may be from about 0.01 weight percent to about 4 weight percent, in embodiments from about 0.09 to about 1 weight percent.

Coalescence may occur over a period of time of from about 0.1 hours to about 10 hours, in embodiments from about 0.5 hours to about 3.5 hours.

Surprisingly, the presence of the transition metal powder and/or transition metal salt may facilitate fast toner coalescence to achieve a circularity of greater than about 0.95. Without this improved process, the toner circularity achieved in a highly pigmented EA toner is less than about 0.94. The addition of the insoluble transition metal powder and/or the addition of the metal salt imparts no detrimental properties to the toner particles. In fact, very little of the metal remains in the final toner.

Subsequent Treatments

In embodiments, after coalescence, the pH of the mixture may then be lowered to from about 3.5 to about 6 and, in embodiments, to from about 3.7 to about 5.5 with, for example, an acid, to further coalesce the toner aggregates. Suitable acids include, for example, nitric acid, sulfuric acid, hydrochloric acid, citric acid and/or acetic acid. The amount of acid added may be from about 0.1 to about 30 percent by weight of the mixture, and in embodiments from about 1 to about 20 percent by weight of the mixture.

The mixture may be cooled, washed and dried. Cooling may be at a temperature of from about 20° C. to about 40° C., in embodiments from about 22° C. to about 30° C., over a period of time of from about 1 hour to about 8 hours, in embodiments from about 1.5 hours to about 5 hours.

In embodiments, cooling a coalesced toner slurry may include quenching by adding a cooling media such as, for example, ice, dry ice and the like, to effect rapid cooling to a temperature of from about 20° C. to about 40° C., in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may not be feasible or practical, neither by the introduction of a cooling medium into the toner mixture, or by the use of jacketed reactor cooling.

The toner slurry may then be washed. The washing may be carried out at a pH of from about 7 to about 12, in embodiments at a pH of from about 9 to about 11. The washing may be at a temperature of from about 30° C. to about 70° C., in embodiments from about 40° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

The toner of the present disclosure may possess particles having a size of from about 3.5 to about 10 microns, in embodiments from about 4.5 to about 8.5 microns. As noted above, the resulting toner particles may have a circularity greater than about 0.95, in embodiments from about 0.95 to about 0.998, in embodiments of from about 0.955 to about 0.97. When the spherical toner particles have a circularity in this range, the spherical toner particles remaining on the surface of the image holding member pass between the contacting portions of the imaging holding member and the contact charger, the amount of deformed toner is small, and therefore generation of toner filming can be prevented so that a stable image quality without defects can be obtained over a long period.

Additives

The toner may also include charge additives in effective amounts of, for example, from about 0.1 to about 10 weight percent of the toner, in embodiments from about 0.5 to about 7 weight percent of the toner. Suitable charge additives include alkyl pyridinium halides, bisulfates, the charge control additives of U.S. Pat. Nos. 3,944,493; 4,007,293; 4,079,014; 4,394,430 and 4,560,635, the entire disclosures of each of which are hereby incorporated by reference in their entirety, negative charge enhancing additives like aluminum complexes, any other charge additives, combinations thereof, and the like.

Further optional additives include any additive to enhance the properties of toner compositions. Included are surface additives, color enhancers, and the like. Surface additives that can be added to the toner compositions after washing or drying include, for example, metal salts, metal salts of fatty acids, colloidal silicas, metal oxides, strontium titanates, combinations thereof, and the like, which additives are each usually present in an amount of from about 0.1 to about 10 weight percent, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 percent by weight, in embodiments from about 0.1 to about 2 percent by weight of the toner, which additives can be added during the aggregation or blended into the formed toner product.

Uses

Toner in accordance with the present disclosure can be used in a variety of imaging devices including printers, copy machines, and the like. The toners generated in accordance with the present disclosure are excellent for imaging processes, especially xerographic processes, which may operate with a toner transfer efficiency in excess of about 90 percent, such as those with a compact machine design without a cleaner or those that are designed to provide high quality colored images with excellent image resolution, acceptable signal-to-noise ratio, and image uniformity. Further, toners of the present disclosure can be selected for electrophotographic imaging and printing processes such as digital imaging systems and processes.

The imaging process includes the generation of an image in an electronic printing apparatus and thereafter developing the image with a toner composition of the present disclosure. The formation and development of images on the surface of photoconductive materials by electrostatic means is within the purview of those skilled in the art. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material referred to in the art as "toner". The toner will normally be attracted to the discharged areas of the layer, thereby forming a toner image corresponding to the latent electrostatic image. This powder image may then be transferred to a support surface such as paper. The transferred image may subsequently be permanently affixed to the support surface as by heat.

Developer compositions can be prepared by mixing the toners obtained with the embodiments of the present disclosure with known carrier particles, including coated carriers, such as steel, ferrites, and the like. See, for example, U.S. Pat. Nos. 4,937,166 and 4,935,326, the disclosures of each of which are hereby incorporated by reference in their entirety. The toner-to-carrier mass ratio of such developers may be from about 2 to about 20 percent, and in embodiments from about 2.5 to about 5 percent of the developer composition. The carrier particles can include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidene fluoride, mixtures of resins not in close proximity in the triboelectric series such as polyvinylidene fluoride and acrylics, thermosetting resins such as acrylics, mixtures thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may also be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer comprises conductive carrier particles and is capable of conducting an electric current between the biased magnet through the carrier particles to the photoreceptor.

Imaging

Imaging methods are also envisioned with the toners disclosed herein. Such methods include, for example, some of the above patents mentioned above and U.S. Pat. Nos. 4,265,990, 4,858,884, 4,584,253 and 4,563,408, the disclosures of each of which are hereby incorporated by reference in their entirety. The imaging process includes the generation of an image in an electronic printing magnetic image character recognition apparatus and thereafter developing the image with a toner composition of the present disclosure. The formation and development of images on the surface of photoconductive materials by electrostatic means is within the purview of those skilled in the art. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Examples 1-8

Preparation of latex resin A. A latex emulsion including polymer particles generated from the emulsion polymerization of styrene, n-butyl acrylate and β-CEA was prepared as follows. A surfactant having about of 605 grams of an alkyldiphenyloxide disulfonate (anionic surfactant) (commercially available as DOWFAX™ 2A1) and about 387 kg de-ionized water was prepared by mixing for about 10 minutes in a stainless steel holding tank. The holding tank was then purged with nitrogen for about 5 minutes before transferring into a reactor. The reactor was then continuously purged with nitrogen while being stirred at about 100 RPM. The reactor was then heated at a controlled tare rate to about 80° C., and held there. Separately, about 6.1 kg of ammonium persulfate initiator was dissolved in about 30.2 kg of de-ionized water.

The monomer emulsion was separately prepared in the following manner. About 311.4 kg of styrene, about 95.6 kg of butyl acrylate, about 12.21 kg of β-CEA, about 2.88 kg of 1-dodecanethiol, about 1.42 kg of dodecanediol diacrylate (ADOD), about 8.04 kg of DOWFAX 2Al (anionic surfactant), and about 193 kg of deionized water were mixed to form an emulsion. About 1% of the above emulsion was then slowly fed into the reactor containing the aqueous surfactant phase at about 80° C. to form seed particles, while being purged with nitrogen. The initiator solution was then slowly charged into the reactor and after about 10 minutes the rest of the emulsion was continuously fed in using a metering pump at a rate of about 0.5%/min. Once all the monomer emulsion was charged into the main reactor, the temperature was held at about 80° C. for an additional 2 hours to complete the reaction. Full cooling was then applied and the reactor temperature was reduced to about 35° C. The product was collected into a holding tank. After drying the latex, the molecular properties were: Mw was about 35,419, Mn was about 11,354 and the onset Tg was about 51° C.

Preparation of latex resin B. A latex emulsion including polymer particles generated from the emulsion polymerization of styrene, n-butyl acrylate and β-CEA was prepared as follows. A surfactant solution including about 605 grams DOWFAX 2A1 (anionic emulsifier) and about 387 kg de-ionized water was prepared by mixing for about 10 minutes in a stainless steel holding tank. The holding tank was then purged with nitrogen for about 5 minutes before transferring into a reactor. The reactor was then continuously purged with nitrogen while being stirred at about 100 RPM. The reactor was then heated at a controlled tare to about 80° C., and held there. Separately about 6.1 kg of ammonium persulfate initiator was dissolved in about 30.2 kg of de-ionized water.

The monomer emulsion was separately prepared in the following manner, about 332.5 kg of styrene, about 74.5 kg of butyl acrylate, about 12.21 kg of β-CEA, about 2.88 kg of 1-dodecanethiol, about 1.42 kg of dodecanediol diacrylate (ADOD), about 8.04 kg of DOWFAX 2A1 (anionic surfactant), and about 193 kg of deionized water were mixed to form an emulsion. About 1% of the above emulsion was then slowly fed into the reactor containing the aqueous surfactant phase at about 80° C. to form seed particles, while being purged with nitrogen. The initiator solution was then slowly charged into the reactor and after about 10 minutes the rest of the emulsion was continuously fed in using metering pump at a rate of about 0.5%/min. Once all the monomer emulsion was charged into the main reactor, the temperature was held at about 80° C. for an additional 2 hours to complete the reaction. Full cooling was then applied and the reactor temperature was reduced to about 35° C. The product was collected into a holding tank. After drying the latex the molecular properties were Mw of about 33,700, Mn of about 10,900 and the onset Tg was about 58.6° C.

About 272 grams (for Examples 7-8, about 215.2 grams) of latex A having a glass transition temperature (Tg) of about 51° C., a solids loading of about 41.99 weight %, and about 69.5 grams of POLYWAX 725 wax emulsion (a polyethylene wax commercially available from Baker Petrolite) having a solids loading of about 29.22 weight %, were added to about 543 grams of deionized water in a vessel and stirred using an IKA Ultra Turrax T50 homogenizer operating at about 4,000 rpm. Thereafter, about 85.7 (for Examples 7-8, about 116.24 grams), grams of an orange pigment dispersion, P034, commercially available from Sun Chemical having a solids loading of about 21.47 weight % followed by drop-wise addition of about 32.4 grams of a flocculent mixture containing about 3.24 grams polyaluminum chloride and about 29.16 grams of about 0.02 molar nitric acid solution. As the flocculent mixture was added drop-wise, the homogenizer speed was increased to about 5,200 rpm and homogenized for an additional 5 minutes. Thereafter, the mixture was heated at about 1° C. per minute to a temperature of about 49° C. and held there for a period of from about 1.5 hours to about 2 hours, resulting in a volume average particle diameter of about 5 microns as measured with a Coulter Counter. During the heat up period, the stirrer was run at about 250 rpm for about 10 minutes. After the set temperature of about 49° C. was reached, the stirrer speed was reduced to about 220 rpm.

Additionally about 118 grams of 58.6° C. Tg latex B was added to the reactor mixture and allowed to aggregate for an additional period of about 30 minutes at about 49° C. resulting in a volume average particle diameter of about 5.7 microns. At this time, the pH was increased to about 4 using a 4% NaOH solution and about 4.34 grams of VERSENE 100 EDTA solution having a solids loading of about 39%, which was added to the mixture resulting in a pH of about 5.4.

Thereafter, the reactor mixture was heated at about 1° C. per minute to a temperature of about 95° C. Following this, the pH was adjusted and a prescribed amount of −200 copper mesh powder, commercially available from Sigma Aldrich, was added to the reactor (for Example 7 a prescribed amount of $Cu(NO_3)_2$ was added to the reactor and for Example 8 a prescribed amount of $Fe(NO_3)_3$ was added to the reactor).

The pH and copper are described in Table 1 below, and the reactor mixture was gently stirred at 95° C. to enable the particles to coalesce and spherodize. The reactor heater was then turned off and the reactor mixture was fast cooled by using a heat exchanger.

Six examples, Examples 1-6, were prepared following the above procedure; slight modifications noted above were made for the synthesis of Examples 7-8.

Comparative Examples 1-2

Two comparative examples, which did not utilize the metal powder as described above in Examples 1-8, were also prepared. Comparative Example 1 was a 20 gallon scale up following the same synthesis described above for Examples 1-6. Comparative Example 2 used a similar formulation; however the coalescence pH was lowered all the way to 3, the lowest possible pH without getting reactor fouling and coarse formation. Details of the toners produced in Examples 1-8 and Comparative Examples 1-2 are set forth below in Table 1.

TABLE 1

| | Additive (% by weight of toner) | pH of Coalescence | Coalescence Total Time | Circularity |
|---|---|---|---|---|
| Example 1 | 0.1 Copper | 4.0 | 2.5 hrs | 0.963 |
| Example 2 | 0.25 Copper | 4.0 | 2 hrs | 0.965 |
| Example 3 | 0.5 Copper | 4.0 | 1.5 hrs | 0.960 |
| Example 4 | 0.75 Copper | 4.0 | 1.5 hrs | 0.966 |
| Example 5 | 1 Copper | 4.0 | 1.5 hrs | 0.970 |
| Example 6 | 0.1 Copper | 4.0 | 2.5 hrs | 0.963 |
| Example 7 | 0.1% $Cu(NO_3)_2$ | 4.0 | 1.2 hrs | 0.965 |
| Example 8 | 0.1$Fe(NO_3)_3$ | 4.0 | 3 hrs | 0.961 |
| Comparative Example 1 | 0 | 4.0 | 3 hrs | 0.937 |
| Comparative Example 2 | 0 | 3.0 | 3 hrs | 0.938 |

Additional toner properties are shown in Table 2 below. D50 is the volume average particle diameter as determined with a Coulter Multisizer (manufactured by Coulter Electronics, Inc. and GSDv/n is the ratio of Volume Average Geometric Size Distribution (GSDv) to Number Average Geometric Size Distribution (GSDn) as determined with a Coulter Multisizer (manufactured by Coulter Electronics, Inc. ICP is the amount of copper (Cu), sodium (Na) or aluminum (Al) found in the toner particles as determined by Inductively Coupled Plasma Emission Spectroscopy (ICP).

TABLE 2

| | Copper (% by weight of toner) | D50 | Toner GSDv/n | Properties Tg | IPC Cu | ICP Na | ICP Al |
|---|---|---|---|---|---|---|---|
| Example 1 | 0.1 | 5.71 | 1.182/1.220 | 53.5 | 29 | 343 | 278 |
| Example 2 | 0.25 | 5.71 | 1.182/1.220 | 54.1 | 41 | 317 | 276 |
| Example 3 | 0.5 | 5.65 | 1.182/1.182 | 53.7 | 109 | 365 | 296 |
| Example 4 | 0.75 | 5.60 | 1.170/1.182 | 54.0 | 468 | 362 | 293 |
| Example 5 | 1 | 5.60 | 1.182/1.195 | 54.1 | 770 | 374 | 302 |
| Example 6 | 0.1 | 5.71 | 1.195/1.182 | 54.0 | 123 | 279 | 296 |
| Example 7 | 0.1% $Cu(NO_3)_2$ | 5.96 | 1.195/1.195 | 53.8 | 14 | 316 | 368 |
| Example 8 | 0.1 $Fe(NO_3)_3$ | 6.01 | 1.170/1.170 | 53.8 | 17 (Fe) | 346 | 454 |
| Comparative Example 1 | 0 | 6.08 | 1.195/1.246 | 53.9 | 0 | 325 | 298 |
| Comparative Example 2 | 0 | 5.70 | 1.182/1.195 | 53.6 | 0 | 269 | 285 |

As can be seen from the data set forth above in Table 1, the addition of copper powder, copper (II) nitrate, or iron (III) nitrate into the reactor at the beginning of coalescence resulted in toner having very high circularity compared to toners with no copper present. All toners having copper added had a circularity of at least about 0.96. Comparative Example 1 was a 20 gallon scale up orange having a final circularity of about 0.937. Comparative Example 2, run at the low pH of 3, had a circularity of only 0.938. It is clear from the above data that without copper powder added at the beginning of coalescence, the circularity would not be within specifications. Most striking was that only 0.1% of the metal powder was necessary to obtain the impact on coalescence.

The amount of copper remaining in the toner particles was measured using Inductively Coupled Plasma Emission Spectroscopy (ICP). FIG. 1 shows a plot of copper added by weight of toner versus the retained copper within the final toner as measured using ICP. FIG. 1 shows that very little copper was retained in the final toner. In fact, as Table 1 suggests, 0.1% copper was enough to coalesce the particles successfully. ICP showed that the resulting toner only contained about 29 ppm of copper in the toner.

Figure 2:
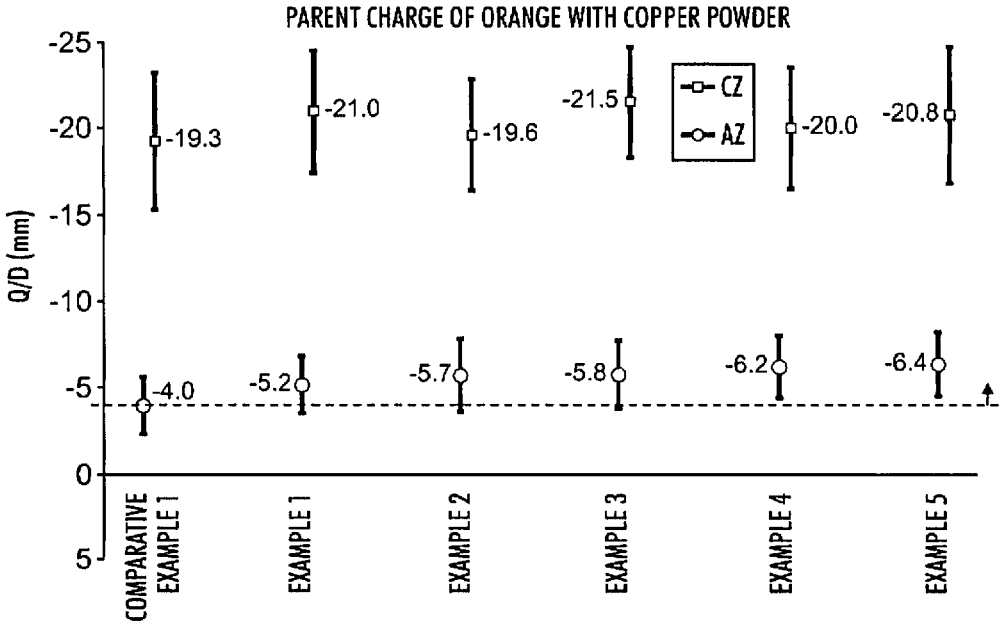
FIG. 2 is a graph depicting parent charging of toner particles of Examples 1-5 and Comparative Example 1 as determined by a charge spectrograph (CSG)

Parent charging for the toner particles was determined by charge spectrograph (CSG) and the results are set forth in FIG. 2 comparing Examples 1-5 and Comparative Example 1. (Q/D is the toner average charge distribution, wherein Q is the charge on the toner particle, and D is the diameter of the particle (in mm).) The data shows that the parent bench charging was not affected by the addition of copper to the process. In fact, the A-zone charge slightly increased with an increase in the amount of copper added.

Figure 3A:
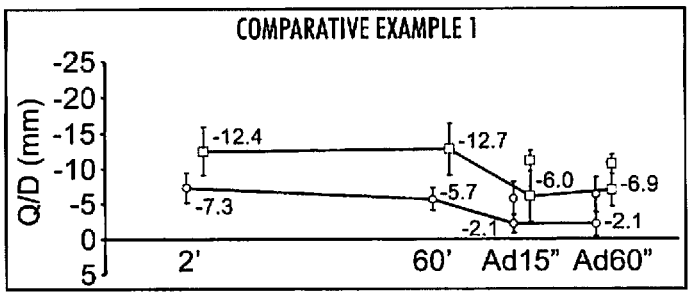
FIGS. 3A-3C are graphs depicting machine charging of toner particles with additives for Examples 1, 5, and Comparative Example 1, as determined by a charge spectrograph (CSG)
Figure 3B:
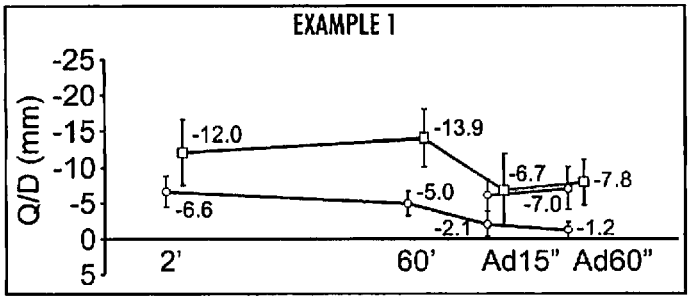
Figure 3C:
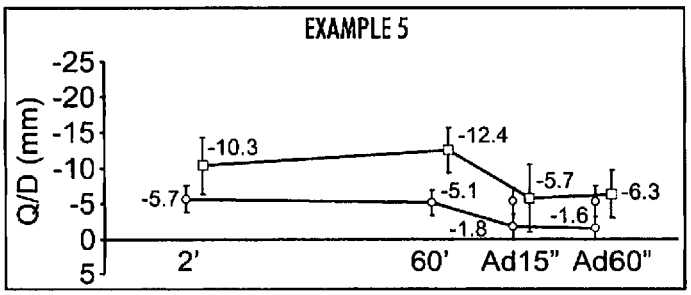

Machine charging data was obtained by charge spectrograph (CSG). Each toner sample was blended on a sample mill for about 30 seconds at about 15000 rpm. Developer samples were prepared with about 0.5 grams of the toner sample and about 10 grams of the carrier. A duplicate developer sample pair was prepared as above for each toner that was evaluated. One developer of the pair was conditioned overnight in A-zone (28° C./85% relative humidity (RH)), and the other was conditioned overnight in the C-zone environmental chamber (10° C./15% RH). The next day the developer samples were sealed and agitated for about 2 minutes and then about 58 minutes using a Turbula mixer. After about 2 minutes and about 58 minutes of mixing, the toner tribo charge was measured using a charge spectrograph using a 100 V/cm field. The toner charge (Q/D)

was measured visually as the midpoint of the toner charge distribution. (The results show the charge in millimeters of displacement from the zero line.) Following the 1 hour of mixing, an additional 0.5 grams of toner sample was added to the already charged developer, and mixed for a further 15 seconds, where a Q/D displacement was again measured, and then mixed for a further 45 seconds (total about 1 minute of mixing), and again a Q/D displacement was measured. The results are set forth in FIG. 3 comparing the Comparative Example 1 scale-up toner (FIG. 3A) with the toners of Example 1 (0.1% Cu added, FIG. 3B) and Example 5 (1% Cu added, FIG. 3C). In the figures, the abscissa represents charge displacement in millimeters, and the ordinate represents mixing time in minutes. The data from FIG. 3 demonstrates that the usage of copper had no impact on the machine charging.

The resistivity and dielectric loss of the toners of Examples 1, 3, and 5, as well as Comparative Example 1, were obtained by first creating a toner pellet in a custom-made fixture. The toner sample was placed in a spring-loaded mold having a 2 inch diameter and pressed by a precision-ground plunger at about 2000 psi for about 2 minutes. While maintaining contact with the plunger (which acted as one electrode), the pellet was then forced out of the mold onto a spring-loaded support, which kept the pellet under pressure and also acted as the counter electrode. Using a HP4263B LCR Meter via shielded 1 meter BNC cables, dielectric and dielectric loss were determined by measuring the capacitance (Cp) and the loss factor (D) at 100 KHz frequency and 1 VAC. Pellet resistivity was determined by measuring the resistance using a HP High Resistance Meter. The results are summarized in Table 3 below. As Table 3 shows, there was no affect of copper on resistivity or dielectric loss.

TABLE 3

| Sample ID | Reactivity and Pellet Resistivity (ohm-cm) | Dielectric Properties Dielectric E' | Properties E'' * 1000 |
|---|---|---|---|
| Comparative Example 1 | 5.5E+12 | 2.6 | 15 |
| Example 1 | 7.0E+12 | 2.5 | 12 |
| Example 3 | 6.5E+12 | 2.6 | 10 |
| Example 5 | 7.6E+12 | 2.5 | 10 |

Figure 4:
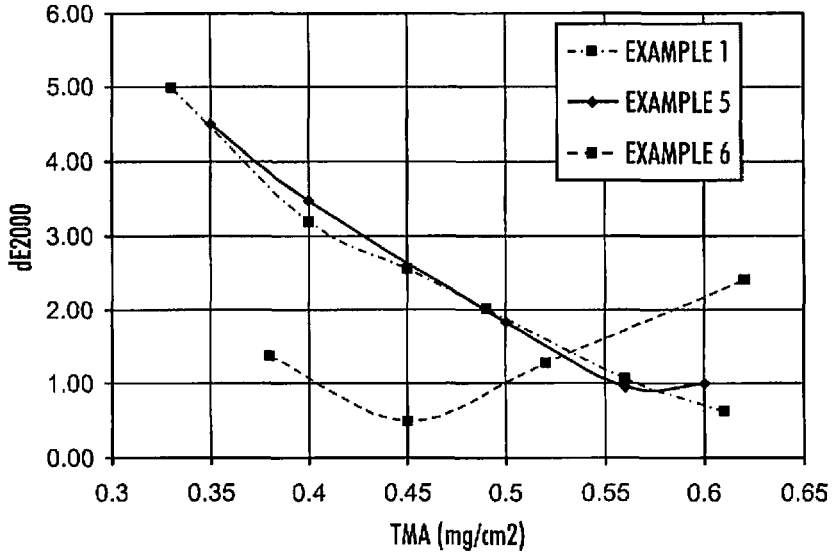
FIG. 4 is a graph depicting pigment loading effect on Delta E2000 and Transferred Mass per Area (TMA) as determined a standard test method using Spectrolino (0/45 geometry, with reflectance measuring mode, D50 light source, 2 degree observer, 4.5 mm aperture, no filter in place, Density_Std: ANSI A, white base: Abs) for toners of Examples 1 and 5 of the present disclosure.

High loadings of pigment. FIG. 4 is a plot of DeltaE2000 versus Transferred Mass per Area (TMA) for Example 1 and 5 toners. The data was obtained with a standard test method using a Spectrolino spectrophotometer from MacBeth Gretag (0/45 geometry, with reflectance measuring mode, D50 light source, 2 degree observer, 4.5 mm aperture, no filter in place, Density_Std: ANSI A, white base: Abs). The toners of the Examples tried to achieve a deltaE2000<2 at a TMA of 0.45. FIG. 4 shows that a pigment loading of about 9.38 weight % was too low, as the deltaE was >2. It was calculated that a pigment loading of about 12.72%/0 was required to get a Pantone match to Orange. This toner was prepared as Example 6 in Table 1. This toner was prepared using only 0.1% by weight of copper added at the beginning of coalescence and the resulting circularity was 0.963 after only 2.5 hours of coalescence at a pH of about 4 and a temperature of about 95° C. This circularity would not have been achievable without the use of a metal powder. The resulting color was measured and the results are set forth in FIG. 4. It was found that the deltaE2000 was <1.

Figure 5:
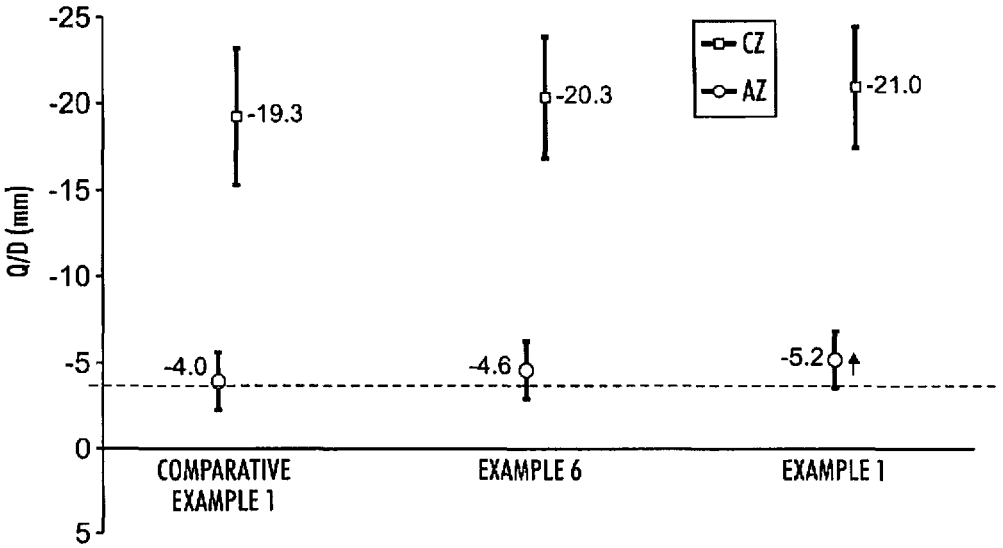
FIG. 5 is a graph depicting parent charging of toner particles of Example 6 as determined by a charge spectrograph (CSG).

Finally, FIG. 5 shows the parent bench charging of the highly pigmented toner in Example 6 as determined by charge spectrograph (CSG). It was found that the high loading of orange pigment had no detrimental impact on charging, due, at least in part, to the fact that the resulting toner particles were highly spherical.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

a) contacting a resin comprising at least two monomers selected from acrylate monomers, styrene monomers and combinations thereof with a colorant, a surfactant and an optional wax to form an emulsion;

b) contacting said emulsion with a coagulant;

c) adding a transition metal salt, wherein said transition metal is copper, zinc, cobalt, nickel, molybdenum, manganese, chromium, vanadium, titanium or alloys thereof, to the emulsion of step b) comprising said coagulant;

d) coalescing the emulsion of step c) comprising said transition metal powder or said transition metal salt over a period of time from about 0.5 hours to about 3.5 hours to form toner; and e) recovering said toner.

2. The process according to claim 1, wherein said resin further comprises poly(styrene-alkyl acrylate), poly (styrene-alkyl acrylate-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid) or a combination thereof.

3. The process according to claim 1, further comprising adding in step a), a stabilizer of formula (I):

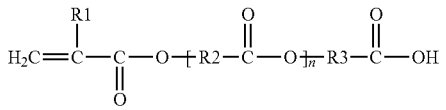

wherein R1 is hydrogen or a methyl group, R2 and R3 are independently selected from alkylene groups containing from about 1 to about 12 carbon atoms or a phenylene group, and n is from about 0 to about 20.

4. The process according to claim 3, wherein said stabilizer comprises β carboxyethyl acrylate, poly(2-carboxyethyl)acrylate, 2-carboxyethyl methacrylate or a combination thereof.

5. The process according to claim 1, wherein said colorant comprises a dye, a pigment, a combination of dyes, a combination of pigments or a combination of a dye and a pigment.

6. The process of claim 1, wherein said colorant is present in an amount from about 8 percent to about 40 percent by weight of said toner.

7. The process according to claim 1, wherein said toner comprises a wax.

8. The process of claim 7, wherein said wax comprises polytetrafluoroethylene wax, polyethylene wax, polypropylene wax, carnauba wax, candelilla wax, beeswax, montan wax, ozokerite, ceresin, paraffin wax, microcrystalline wax, a Fischer-Tropsch wax, or a combination thereof.

9. The process of claim 7, wherein said wax is present in an amount from about 0.1 percent to about 30 percent by weight of said toner.

10. The process according to claim 1, wherein said coagulant comprises a polymetal salt.

11. The process of claim 1, wherein said coagulant comprises a polyaluminum halide, a polyaluminum silicate, a water soluble metal salt, or a combination thereof.

12. The process of claim 1, further comprising following step b) and before step c), adding to said emulsion of step b), a shell resin.

13. A process comprising:

a) contacting a resin comprising at least two monomers comprising an acrylate monomer, a styrene monomer or a combination thereof with, a colorant, a surfactant and an optional wax to form an emulsion;

b) contacting said emulsion with a coagulant;

c) adding a transition metal salt wherein said transition metal salt comprises copper II nitrate or iron nitrate to the emulsion of step b) comprising a coagulant;

d) coalescing the emulsion of step c) comprising said transition metal salt of step c) over a period of time from about 0.5 hours to about 3.5 hours to form toner; and e) recovering said toner.

14. A process comprising:

a) contacting a resin comprising at least two monomers comprising an acrylate monomer, a styrene monomer or a combination thereof with, a colorant, a surfactant and an optional wax to form an emulsion;

b) contacting said emulsion with a coagulant;

c) adding a transition metal salt selected from the group consisting of nitrates, sulfates, halides, acetates, phosphates, oxides, hydroxides, carbonates and combinations thereof, comprising a metal selected from the group consisting of copper, iron and combinations thereof to the emulsion of step b) comprising a coagulant;

d) coalescing the emulsion of step c) comprising said transition metal salt of step c) over a period of time from about 0.5 hours to about 3.5 hours to form toner; and e) recovering said toner;

further comprising adding in step a), a stabilizer of formula (I):

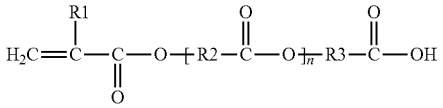

wherein R1 is hydrogen or a methyl group, R2 and R3 are independently selected from alkylene groups containing from about 1 to about 12 carbon atoms or a phenylene group, and n is from about 0 to about 20.

15. The process according to claim 14, wherein said colorant is present in an amount from about 8 percent to about 40 percent by weight of said toner.

16. The process according to claim 14, further comprising following step b) and prior to step c), adding to said emulsion of step b), a shell resin.

* * * * *